United States Patent [19]

Vogler

[11] 4,259,580

[45] Mar. 31, 1981

[54] CONTROL CIRCUIT FOR A ROTARY-ANODE X-RAY TUBE

[75] Inventor: Gerd Vogler, Hamburg, Fed. Rep. of Germany

[73] Assignee: U.S. Philips Corporation, New York, N.Y.

[21] Appl. No.: 917,976

[22] Filed: Jun. 22, 1978

[30] Foreign Application Priority Data

Jul. 21, 1977 [DE] Fed. Rep. of Germany ..... 2732852

[51] Int. Cl.[3] ..... H05G 1/70

[52] U.S. Cl. ..... 250/402; 250/406

[58] Field of Search ..... 250/402, 406

[56] References Cited

U.S. PATENT DOCUMENTS

| | | | |
|---|---|---|---|
| 3,518,434 | 6/1970 | Lombardo | 250/406 |
| 3,564,254 | 2/1971 | Siedband | 250/406 |
| 4,065,673 | 12/1977 | Tiocca | 250/406 |

*Primary Examiner*—Craig E. Church

*Attorney, Agent, or Firm*—William J. Streeter; Bernard Franzblau

[57] ABSTRACT

Known circuit arrangements which measure and indicate the speed of a rotary-anode X-ray tube require that sensors be provided in the tube cover. This invention, however, does not require any modification in the tube cover and still provides an accurate speed measurement. According to the invention, the amplitudes $I_1$, $I_2$ of the currents through the two stator winding pairs are multiplied together and by the sine of the phase angle between the two currents. For a predetermined moment of inertia of the anode disc a given speed is reached when the integral of the product thus formed has reached a given value. When use is made of a rotary-anode X-ray tube whose anode discs have different moments of inertia, a predetermined speed is reached if the integral of the product $I_1 \cdot I_2 \cdot \sin \alpha$ has reached a value proportional to the moment of inertia of the anode disc of the associated X-ray tube.

8 Claims, 8 Drawing Figures

Figure 1:
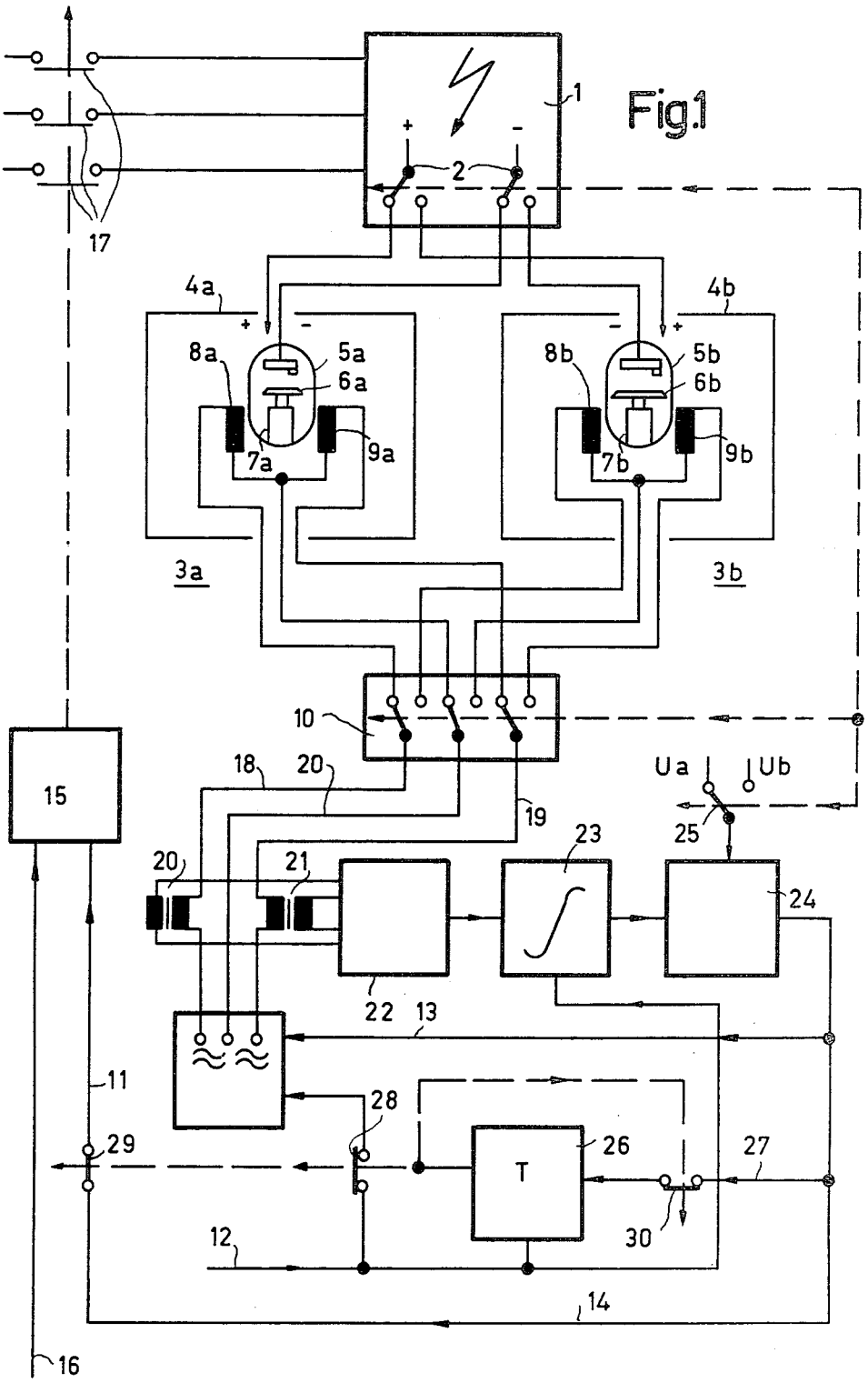

1
2
17
4a
4b
8a
5a
6a
7a
9a
8b
5b
6b
7b
9b
3a
3b
10
15
18
20
19
Ua
Ub
25
23
24
21
22
13
11
28
29
26
T
27
30
12
14
16

CONTROL CIRCUIT FOR A ROTARY-ANODE X-RAY TUBE

The invention relates to a circuit arrangement for a rotary-anode X-ray tube for starting an X-ray exposure when the rotary anode reaches a predetermined speed. This circuit arrangement comprises a control circuit having inputs which receive signals which are proportional to the currents through the stator windings of a drive motor for the rotary anode and a comparison circuit which starts the X-ray exposure and under control of the output signal of the control circuit.

A circuit arrangement of this kind is known from U.S. Pat. No. 3,518,434. The control circuit thereof determines whether a current flows through both stator windings. If this is the case, a capacitor is charged. The voltage of the capacitor is compared with a constant d.c. voltage by the comparison circuit, which supplies a signal which indicates that the X-ray exposure may be started if the capacitor voltage equals the d.c. voltage. At the same time, the power applied to the stator windings is reduced.

The rotary anode should reach the required speed within the period of time expiring between the beginning of the charging of the capacitor and the start of an X-ray exposure, even in the most unfavourable conditions. In normal circumstances, however, this period of time will be too long, i.e. the X-ray exposure is permitted later than necessary and too much power is applied to the stator windings.

In order to prevent this phenomenon, it is already known (U.S. Pat. No. 3,244,884) to record, by means of an electro-acoustic converter, the running noise of the rotary anode, to evaluate this noise and to start the exposure if a running noise characteristic of the adjusted speed is obtained. However, in the course of time the running noise of the rotary anode in an X-ray tube changes and, moreover, the running noise is not even the same for X-ray tubes of the same type. Therefore, the operation of this device is not very reliable.

It is also known (U.S. Pat. No. 3,214,589) to measure the speed of the rotary anode of a rotary anode X-ray tube by means of a photocell arranged on the cover of the X-ray source and which measures the light emitted by the cathode filament through a hole in the anode disc and which converts this light into an electrical signal. This device requires on the one hand a rotary-anode tube comprising a rotary anode provided with a hole, and on the other hand that either the photocell, or a mirror which reflects the light emitted by the cathode to the photocell, be arranged in the cover. This means that some form of intervention or physical modification is required in the X-ray tube itself, as well as in the cover in which the X-ray tube is arranged.

An object of the present invention is to provide a simple, reliable circuit arrangement which indicates that the desired speed has been attained without the necessity of an intervention in the X-ray tube or the tube cover.

To this end, the circuit arrangement in accordance with the invention is characterized in that the control circuit comprises an arithmetic device which supplies an output signal which is proportional to the time integral of the product $I_1 \cdot I_2 \cdot \sin \alpha$, $I_1$ and $I_2$ being the amplitudes of the currents $i_1$ and $i_2$ in the stator windings and $\alpha$ being the phase angle between the two currents $i_1$ and $i_2$.

The invention is based on the assumption that the motor drive for a rotary anode X-ray tube comprises two stator winding pairs which have been mutually shifted 90° with respect to the axis of rotation (one pair comprises two windings spatially shifted ½° with respect to each other) and a cylindrical rotor (squirrel cage rotor). For the acceleration of the anode mass, which is comparatively large with respect to the very low bearing friction, the following relation is applicable; the drive torque is proportional to the product of the magnetic flux through the two stator windings multiplied by the sine of the phase angle between the two currents and by the rotor efficiency. Provided that the rotor efficiency and the anode inertia are constant and that a linear relationship exists between the electrical currents $i_1$ and $i_2$ through the windings and the magnetic flux in these windings, the time integral of $I_1 \cdot I_2 \cdot \sin \alpha$ would also be proportional to the speed reached at any instant during acceleration.

However, in practice the rotor efficiency is dependent on the speed and so, in spite of a constant rotary field, the variation of the speed as a function of the time is not linear. However, it is still true that a predetermined speed is reached when the time integral of the product $I_1 \cdot I_2 \cdot \sin \alpha$ has reached a given value.

When a constant value is compared with the time integral in the comparison circuit and the X-ray exposure is started when the time integral has reached the constant value, the X-ray exposure is always started at the same predetermined speed. When a different reference value is adjusted, the X-ray exposure is started at a different speed of the rotary anode.

Fluctuations in the linear relationship between the electrical current through the stator windings and the magnetic flux due to saturation phenomena may be compensated for by suitable amplitude filters, if desired.

An advantage of the circuit arrangement in accordance with the invention over the known circuit arrangement consists in that the X-ray exposure can be started and/or the power applied to the stator can be reduced with a comparatively high accuracy when a predetermined speed is reached, and without any modification being required in the rotary anode X-ray tube or in the cover enclosing the rotary anode X-ray tube.

A particularly simple preferred embodiment of a circuit arrangement in accordance with the invention is characterized in that the arithmetic device comprises a multiplier circuit for multiplying two a.c. voltages, one a.c. voltage being proportional to the instantaneous value of the current through the one stator winding, while the other a.c. voltage is proportional to the amplitude of the current through the other stator winding, the latter a.c. voltage being phase shifted 90° with respect to the latter current. The output signal of the multiplier circuit is applied to an integrator circuit having an output which is connected to the input of the comparison circuit.

In X-ray systems comprising a number of X-ray stations, one X-ray generator attends to several rotary anode X-ray tubes. It may be that different tube types are concerned, whose rotary anodes have a different moment of inertia. The use of a single circuit arrangement in accordance with the invention suffices also in systems of this kind because a further embodiment of a circuit arrangement in accordance with the invention is characterized in that for each X-ray tube there is provided a d.c. voltage generator which is connected to an input of the comparison circuit, the ratio of the d.c.

voltages of the various d.c. voltage generators being the same as that of the moments of inertia of the rotary anodes of the associated X-ray tubes. In this respect use is made of the fact that the drive torque equals the product of the moment of inertia and the variation of the speed as a function of the time. Therefrom it follows that for a given speed to be reached, the drive torques, and hence the values of the output signal of the arithmetic device at which the comparison circuit starts the X-ray exposure, must relate to each other in the same way as the moments of inertia of the associated X-ray tubes.

Figure 2:
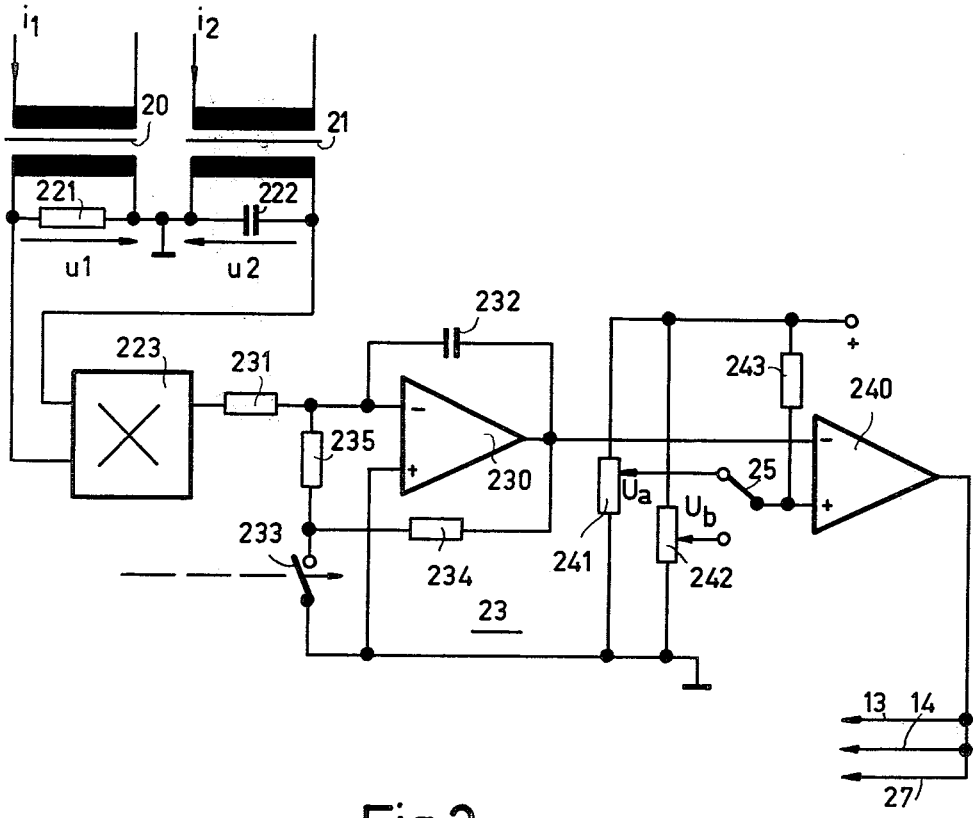
Figure 3:
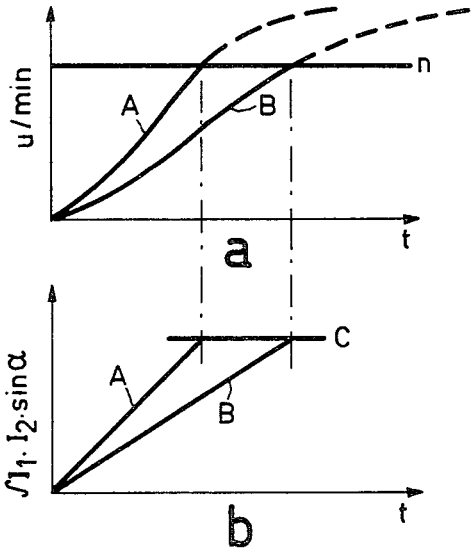
Figure 4:
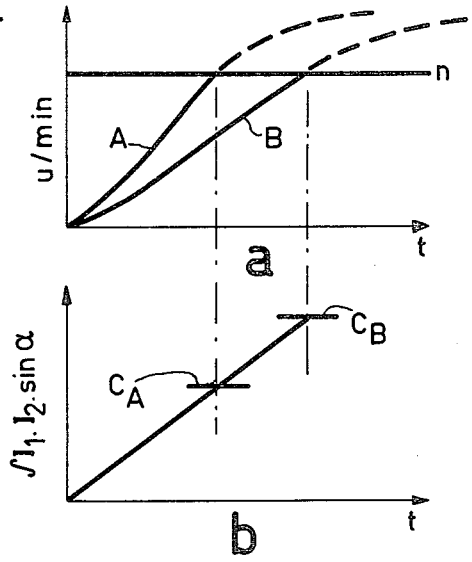
Figure 5:
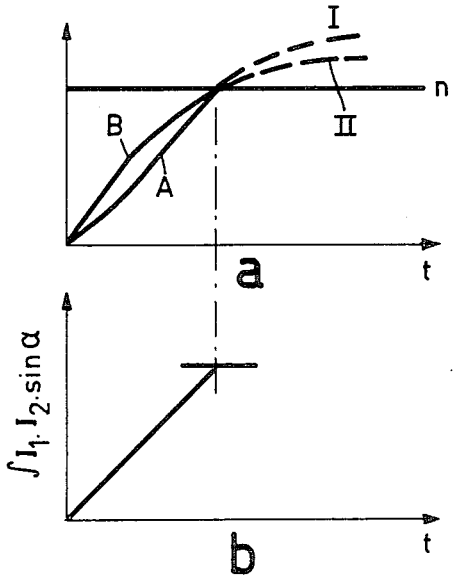

A preferred embodiment of the circuit arrangement in accordance with the invention will be described in detail hereinafter with reference to the accompanying diagrammatic drawing in which:

FIG. 1 shows a block diagram of an X-ray generator comprising a circuit arrangement in accordance with the invention, FIG. 2 shows a particularly simple embodiment of the circuit arrangement in accordance with the invention, FIGS. 3*a* to 5*b* show the variation of the speed or the time integral of $I_1 \cdot I_2 \cdot \sin \alpha$ as a function of the time for different rotary fields (FIGS. 3*a* and 3*b*), for different moments of inertia (FIGS. 4*a* and 4*b*), and for different rotor temperatures (FIGS. 5*a* and 5*b*).

As appears from the FIGS. 3*a* and 3*b*, the speed increases more slowly in the case of a weak rotary field (curve B) than in the case of a strong magnetic field (curve A). The time integral of the value $I_1 \cdot I_2 \cdot \sin \alpha$ reaches a predetermined value C later, however, in the same ratio as the predetermined speed n is reached later.

FIG. 4*a* shows the variation with time of the speed of two rotary anodes having a different moment of inertia, for otherwise the same circumstances. The speed of the rotary anode having the larger moment of inertia (curve B) increases more slowly than the speed of the rotary anode having the smaller moment of inertia (curve A). The curve B has increased with time with respect to the curve A in the same ratio as the moment of inertia thereof is larger than the moment of inertia of the rotary anode associated with the curve A. The different moments of inertia of the rotary anodes can be taken into account in that the predetermined reference value, $C_A$ or $C_B$, exhibit the same ratio as the moments of inertia (FIG. 4*b*). If this is the case, the X-ray exposure is always started at the same speed, regardless of the moment of inertia of the rotary anode.

A change in the rotor temperature causes a change in the rotor efficiency and hence also in the starting behaviour of the rotary anode. As is shown in FIG. 5*a*, the rotary anode will accelerate more slowly in the case of a low rotor temperature (curve I) than in the case of a higher rotor temperature (curve II). These changes per se are not taken into account by the circuit arrangement in accordance with the invention. However, the effect of the rotor temperature can be eliminated to a high degree by adaptation of the shape of the rotor to the ratio between the synchronous speed (which is the speed determined by the frequency of the stator field) and the adjusted speed (which is the speed at which the X-ray exposure is to be started).

If the construction of the rotor is chosen, by variation of the thickness of the cylinder wall, so that the maximum drive torque is reached at approximately half the synchronous speed of the rotary anode (in this case the ohmic resistance of the rotor equals its inductive reactance), the range of the maximum drive torque in the warm condition (increased ohmic resistance of the rotor) is shifted in the direction of the foot of the starting curves. As appears from the FIGS. 5*a* and 5*b*, the two curves intersect at a given speed, the point of intersection being dependent on the construction of the rotor, particularly on the thickness of the cylinder wall and also of the synchronous speed. If these parameters are chosen so that the point of intersection is situated at the adjusted speed (FIG. 5*b*), the time required by the rotor for reaching the adjusted speed is independent of its temperature.

Different stator temperatures may cause a change of the product $I_1 \cdot I_2 \cdot \sin \alpha$, so that such differences are taken into account by the circuit arrangement in accordance with the invention, as appears from the FIGS. 3*a* and 3*b*.

The reference numeral 1 in FIG. 1 denotes a high voltage generator which serves to power two X-ray sources 3*a* and 3*b*, one of which can each time be connected, by way of a high voltage switch 2, to the high voltage generated in the high voltage generator 1. Each X-ray source 3*a*, 3*b* comprises an X-ray cover 4*a*, 4*b*, respectively, and a rotary anode X-ray tube 5*a*, 5*b*, respectively. The rotary anode 6*a*, 6*b* is connected to a cylindrical rotor 7*a*, 7*b*, respectively, of copper. The stator for driving the rotor 7*a*, 7*b* consists of two stator winding pairs 8*a* and 9*a*, and 8*b* and 9*b*, respectively, which have been shifted through 90° in space with respect to each other, each pair generating two magnetic fields which extend perpendicularly to the axis of rotation of the rotor (7*a*, 7*b*) and which vary in the time. Each winding pair consists of two windings which have been shifted 180° with respect to each other.

The stator winding pairs 8*a* and 9*a* of the rotary anode X-ray tube 5*a* are connected, via a switch 10, to an a.c. voltage generator 11 which supplies the required a.c. voltage having a higher frequency of, for example, 180 Hz. In the other position of the high-voltage switch 2 and of the switch 10, the stator windings 8*b* and 9*b* of the X-ray tube 5*b* are connected to the a.c. voltage generator 11 via the switch 10.

The a.c. voltage generator is designed for two power stages: For a high power for a brief period of time which is used to accelerate the rotary anode 6*a* or 6*b* from standstill until the desired speed is reached (this power stage is switched on when a preparation signal is present on the line 12 prior to the start of the actual X-ray exposure), and for a low power where the rotor of the driven rotary anode X-ray tube is supplied with just so much energy that the rotor can maintain the speed reached. The a.c. voltage generator 11 is switched over to this power when the line 13 carries a signal which indicates that the desired speed has been reached. This signal also starts the X-ray exposure via the line 14, so that when an exposure command is present on the line 16, the timer 15 closes the power switch 17 in the primary circuit of the high voltage generator during the exposure time, predetermined in a manner not shown, with the result that the high voltage is applied to the connected X-ray source via the high voltage switch 2. The X-ray generator described thus far is known.

In accordance with the invention, the primary winding of one of the current transformers 20 and 21 is included in each of the two supply lines 18 and 19 which connect the outputs of the a.c. voltage generator to the primary windings 8*a* and 9*a*. The secondary windings of the two current transformers 20 and 21 are connected to the inputs of a circuit 22 which supplies an output signal which is proportional to the product $I_1 \cdot I_2 \cdot \sin \alpha$. Therein, $I_1$ represents the amplitude of the current $i_1$ in the supply line 18 or in one of the stator winding pairs 8*a* or 8*b*, and $I_2$ represents the amplitude of the current $i_2$ in the supply line 19 or in one of the stator winding pairs 9*a* or 9*b*. The two currents return to the a.c. voltage generator 11 via the common return line 20. The output of the circuit 22 is connected to the input of an integrator circuit 23 whose output signal is proportional to the time integral of its input signal, and in turn is applied to an input of a comparison circuit 24 which compares this signal with a predetermined d.c. voltage.

To this end, the other input of the comparison circuit 24 can be connected, as desired, via a switch 25, to one of the two d.c. voltages $U_a$, $U_b$. As is denoted by broken lines, the switch 25 is coupled to the switching device 10 and to the high voltage switch 2 so that when the X-ray tube 5*a* is connected to the high voltage generator 1 and its stator windings are connected to the a.c. voltage generator 11, the switch 25 always connects the input of the comparison circuit 24 to the d.c. voltage $U_a$, whereas in the other position of the switching device 10 and of the high voltage switch 2, in which the X-ray tube 5*b* is powered by high voltage and the stator winding pairs 8*b* and 9*b* thereof are activated, the voltage $U_b$ is applied to the other input of the comparison circuit 24. The ratio of the d.c. voltages $U_a$ and $U_b$ is the same as that of the moments of inertia of the rotary anodes of the associated X-ray tubes 5*a* and 5*b*.

The comparison circuit 24, the output of which is connected to supply lines 13 and 14, supplies an output signal when the output signal of the integrator circuit 23 reaches the value $U_a$ ($U_b$), said output signal changing over the a.c. voltage generator 11 from high to low power (via the line 13) and starting the X-ray exposure (via the line 14).

In a device of this kind it may occur that, due to some defect, no adequate rotary field is realised so that the rotary anode cannot reach the desired speed. For this purpose there is provided a time element 26 which is proportioned so that it is not activated for all starting times occurring during operation. It is started by the preparation signal on the line 12 and is reset by the output signal of the comparison circuit 24 which is applied, via the line 27, to the reset input of the time element 26.

Activation of the time element 26 opens the switch 28 via which the preparation signal reaches the control input of the a.c. voltage generator so that this generator is switched off and thus is protected against overloading. At the same time, the exposure is blocked in that the switch 29, included in the start line 14, is opened, after which a switch 30 in the connection line to the reset input of this time element is also opened, as denoted by the broken lines, so that starting cannot take place, not even in the course of time (for example, by drifting of the integrator 23). The device becomes ready for use again only after the preparation signal on the line 12 has been removed.

The device 22, supplying a signal which is proportional to the product $I_1 \cdot I_2 \sin \alpha$, may comprise, for example, a peak value rectifier which generates a d.c. voltage which is proportional to the amplitude $I_1$ of the current through the stator winding pair 8*a* (8*b*), and also a so-called sample-and-hold circuit which, upon a zero crossing of the current through the stator winding pair 8*a* (8*b*), detects and stores the instantaneous value of the current through the other stator winding pair 9*a*(9*b*). The output signal of the sample-and-hold circuit is proportional to the term $I_2 \cdot \sin \alpha$. When the output signals of the peak value rectifier and the sample-and-hold circuit are multiplied by each other, a signal is obtained which is proportional to the product $I_1 \cdot I_2 \cdot \sin \alpha$.

FIG. 2 shows an even simpler circuit arrangement in which the same reference numerals have been used for corresponding components. The secondary winding of the current transformer 20, through the primary winding of which flows the current $i_1$ of the stator winding pair 8*a* or 8*b*, is connected parallel to an ohmic resistor 221. A capacitor 222 is connected parallel to the secondary winding of the current transformer 21, through the primary winding of which flows the current $i_2$ of the stator winding pair 9*a* or 9*b*, said capacitor ensuing that the voltage on the secondary winding is shifted 90° with respect to the current $i_2$ in the primary winding. Therefore, if the following relations are valid for the currents $i_1$ and $i_2$:

$$i_1 = I_1 \sin wt \quad (1)$$

and $$i_2 = I_2 \sin (wt = \alpha), \quad (2),$$

the following relation is valid for the voltage $u_1$ on the resistor 221:

$$U_1 = U_1 \sin wt \quad (3)$$

and for the voltage $u_2$ on the capacitor 222

$$u_2 = -U_2 \cos (wt + \alpha) \quad (4).$$

The two voltages $u_1$ and $u_2$ are applied to the inputs of a multiplier circuit 223. The output signal thereof is therefore proportional to the term $$U_1 \cdot U_2 \cdot (\sin \alpha - \sin (2wt + \alpha)) \quad (5)$$

The equation (5) shows that the output of the multiplier device not only carries the component $U_1 \cdot U_2 \cdot \sin \alpha$, being proportional to the term $I_1 \cdot I_2 \sin \alpha$, because $U_1$ is proportional to $I_1$ and $U_2$ is proportional to $I_2$, but also a component having double the frequency of the a.c. voltage of the a.c. voltage generator 11 (FIG. 1).

The output voltage of the multiplier circuit 223 is applied to the integrator circuit 23 which comprises an operational amplifier 230, the inverting input of which is connected to the output of the multiplier device, via a resistor 231 and the output of which is connected to the inverting input via a capacitor 232. The resistor 231, the capacitor 232 and the gain of the operational amplifier 230 are proportioned so that a d.c. component present at the output of the multiplier stage 223 causes a voltage at the output of the integrator circuit which linearly increases with time during the starting period of the rotary anode (i.e. the period of time required by the rotary anode to reach the desired speed from standstill). After a starting period T, being in the order of magnitude of some tenths of a second, a voltage is obtained at the output of the integration element 230 which is proportional to the term $$U_1 \cdot U_2 (T \sin \alpha + (1/2w) \cdot \cos (wt + \alpha)) \quad (6)$$

Because, as has already been stated, the starting period T amounts to some tenths of a second, and the frequency of the a.c. voltage supplied by the a.c. voltage generator 11 is, for example 180 Hz, the following relation is valid:

$$T >> (1/2w) \quad (7)$$

which means that the output voltage of the integration element is proportional to the expression $$U_1 \cdot U_2 \cdot T \cdot \sin \alpha \quad (8)$$

and, therefore, to the time integral of the product $$I_1 \cdot I_2 \cdot \sin \alpha \quad (9)$$

The integrator circuit 23 is started by closing switch 233 at the beginning of the preparation phase, said switch connecting the junction of two resistors, one of which (234) is connected to the output and the other one (235) of which is connected to the inverting input of the operational amplifier 230, to ground. After the beginning of the exposure, the switch 233 is opened again so that the capacitor 232 is discharged via the series connection of the resistors 234 and 235, which means that the integrator circuit 23 has been reset to its starting position.

The output signal of the integrator circuit 23, being also proportional to the speed for the reasons described at the beginning, is applied to the inverting input of an operational amplifier 240, the non-inverting input of which is connected, selectively via the switch 25, to the tapping of one of the two potentiometers 241, 242, wherefrom the d.c. voltage $U_a$, $U_b$ can be derived. As soon as the output voltage of the integrator circuit 23 becomes more positive than the d.c. voltage on the non-inverting input of the operational amplifier 240, a negative voltage transient is obtained at the output of the amplifier which can be used for starting the X-ray exposure, for reducing the power of the a.c. voltage generator, and for resetting the time element 26.

The comparison circuit formed by the operational amplifier 240 is thus activated when the time integral of the product given in the equation (9) has reached a predetermined value. If $I_1$ and $I_2$ are smaller than usual due to a.c. supply voltage fluctuations, the rotary anode requires more time than usual to reach the desired speed. However, the time required by the time integral of this product to reach the predetermined value $U_a$, $U_b$ is then also longer. The same effect occurs when the phase angle $\alpha$ between the two currents deviates from the optimum phase angle (90°).

As has already been stated, the time integral of the product $I_1$, $I_2 \cdot \sin \alpha$ is a measure of the relevant speed of the rotary anode only if a linear relationship exists between the current $I_1$, $I_2$ through a stator winding and the magnetic flux in this winding. However, this linear relationship does not exist if at least part of the stator stack operates in the saturation range. The error caused thereby can be avoided, however, by applying each one of the voltages $U_1$, $U_2$ of the multiplier circuit 223 via an amplitude filter, the output voltage of which has the same dependency on its input voltage as the magnetic flux through a winding on the electrical current through this winding. An amplitude filter of this kind may be realized by a network of linear and non-linear resistors (for example, diodes or Zener diodes).

What is claimed is:

1. In a circuit for initiating operation of an X-ray generator including a rotary anode X-ray tube and means for switching the X-ray tube on and off, the improvement comprising, a rotary anode drive motor that includes a rotor coupled to the rotary anode and first and second stator windings disposed at right angles about the axis of rotation of the rotary anode, means for sensing starting currents $i_1$ and $i_2$ flowing in the respective first and second stator windings, an arithmetic device having an input coupled to the output of the current sensing means and including means for deriving an output signal which is proportional to the time integral of a product $I_1 \cdot I_2 \sin \alpha$, $I_1$ and $I_2$ being the amplitudes of the stator winding currents $i_1$ and $i_2$, respectively and $\alpha$ being the phase angle between the two stator currents $i_1$ and $i_2$, means for applying said output signal to a first input of a comparison circuit, means for supplying a preset reference value signal indicative of a minimum required anode speed to a second input of the comparison circuit such that the comparison circuit produces an output control signal if the output signal of the arithmetic device exceeds the preset reference value signal, and means coupling the output control signal of the comparison circuit to the switching means for enabling an X-ray exposure.

2. A circuit as claimed in claim 1 wherein the current sensing means includes means for deriving first and second a.c. voltages proportional to the instantaneous values of the currents $i_1$ and $i_2$ flowing in the first and second stator windings, respectively, and with the second a.c. voltage phase shifted 90° with respect to the stator current $i_2$, and the arithmetic device comprises a multiplier circuit for multiplying said first and second a.c. voltages, and means for coupling an output signal of the multiplier circuit to an integrator circuit having an output connected to said first input of the comparison circuit.

3. A circuit as claimed in claim 1 wherein the X-ray generator includes at least two rotary anode X-ray tubes having different moments of inertia, and said reference value signal supplying means comprises a reference value generator for generating at least two different reference value voltages corresponding to said two rotary anode X-ray tubes with the ratio of the voltages being equal to the ratio of the moments of inertia of the rotary anodes of the X-ray tubes.

4. A circuit as claimed in claim 1 wherein the current sensing means comprises first and second transformers each having a primary winding and a secondary winding and with each primary winding connected in series with a respective one of the first and second stator windings, a resistor, a capacitor, means connecting the resistor across the secondary winding of the first transformer for producing a first a.c. voltage in phase with the stator current in the primary winding thereof, and means connecting the capacitor across the secondary winding of the second transformer for producing a second a.c. voltage that is 90° out of phase with the stator current in the primary winding of the second transformer, said first and second a.c. voltages being coupled to the input of the arithmetic device to provide input signals upon which the arithmetic device operates.

5. A circuit as claimed in claim 4 wherein the arithmetic device comprises an analog multiplier circuit and an integrator connected in cascade between output terminals of the secondary windings of the first and second transformers and the first input of the comparison circuit.

6. A control circuit for monitoring the rotational speed of the anode of a rotary anode X-ray tube and for initiating operation of the X-ray tube at a predetermined anode speed comprising, switching means for applying an energizing voltage to the X-ray tube in response to a control voltage, a drive motor that includes a rotor coupled to the rotary anode and first and second stator windings displaced in phase relative to one another, a source of a.c. electric energy coupled to said first and second stator windings for supplying a.c. currents $i_1$ and $i_2$ to the first and second stator windings, respectively, means for sensing starting currents $i_1$ and $i_2$ in the respective stator windings, an arithmetic device coupled to the output of the current sensing means and including means for deriving an output signal indicative of the anode speed and which is proportional to the time integral of the product $I_1 \cdot I_2 \sin\alpha$, $I_1$ and $I_2$ being the amplitudes of the stator winding currents $i_1$ and $i_2$, respectively, and $\alpha$ being the phase angle between the two stator currents $i_1$ and $i_2$, means for applying said output signal to a first input of a comparison circuit, a source of reference voltage indicative of said predetermined anode speed coupled to a second input of the comparison circuit so that the comparison circuit produces said control voltage upon equality of the arithmetic device output signal and the reference voltage, and means responsive to said control voltage for operating said switching means to energize the X-ray tube and initiate the operation thereof.

7. A control circuit as claimed in claim 6 wherein the arithmetic device comprises an analog multiplier circuit and an integrator circuit connected in cascade between the output of the current sensing means and the first input of the comparison circuit.

8. A control circuit as claimed in claim 6 wherein said operating means includes a timer device for timing the operation period of the X-ray tube.

* * * * *